United States Patent [19]

Tsuyoshi et al.

[11] Patent Number: 4,881,289

[45] Date of Patent: Nov. 21, 1989

[54] PAINT-COATING BRUSH

[75] Inventors: Nagata Tsuyoshi; Fujita Katsuto, both of Osaka, Japan

[73] Assignee: Sunstar Engineering Inc., Osaka, Japan

[21] Appl. No.: 186,596

[22] Filed: Apr. 27, 1988

[51] Int. Cl.[4] ..... A46B 9/12

[52] U.S. Cl. ..... 15/168; 15/191 A; 15/DIG. 4; 401/288; 118/697

[58] Field of Search ..... 15/29, 168, 169, 191 R, 15/191 A, 192, DIG. 4; 401/286, 288; 118/697

[56] References Cited

U.S. PATENT DOCUMENTS

| | | | |
|---|---|---|---|
| 288,598 | 11/1883 | Stevens | 15/169 X |
| 530,386 | 12/1894 | Boeckh, Jr. | 15/168 |
| 2,313,865 | 3/1943 | Dworkin | 401/288 |
| 2,989,767 | 6/1961 | Charvat | 15/168 X |

FOREIGN PATENT DOCUMENTS

| | | | |
|---|---|---|---|
| 2181 | 1/1898 | United Kingdom | 15/168 |

*Primary Examiner*—Peter Feldman

*Attorney, Agent, or Firm*—Koda and Androlia

[57] ABSTRACT

A paint-coating brush is disclosed which comprises a body with an axial center bore and with a threaded portion on the butt side, a plurality of piliform members bundled on the outer surface of a muzzle-side end portion of the body, a cylindrical sleeve for fastening the piliform members to the body, and a cylindrical cover tube with which the piliform members are sheathed in such a manner that one end portion of the piliform members is left unsheathed. The cover tube is either made of a rigid material or in the form of a strap wound round the piliform members and the sleeve. In order to mount this paint-coating brush on an automatic paint-coating installation such as a robot, the above-mentioned threaded portion of the body is threaded into a tapped hole in the paint-coating installation.

2 Claims, 2 Drawing Sheets

PAINT-COATING BRUSH

BACKGROUND OF THE INVENTION

The present invention relates to a paint-coating brush to be mounted on an installation for the automatic application of a paint by means of a robot or the like.

Automatic installations have been used for the application of a paint such as a primer, varnish or adhesive, wherein a robot, manipulator or the like forms a part of the installation of this type. However, various problems are derived from the fact that the paint-coating brushes used in the conventional automatic installations are similar in construction to the paint-coating brushes used in manual painting.

FIG. 3 shows a conventional paint-coating brush B, which comprises a metal body 1, a plurality of piliform members 4, and a cylindrical sleeve 9 for fastening the piliform members 4 to the body 1.

The body 1 is provided with a threaded portion 6 on the butt side and a cylindrical spindle-shaped portion 8 on the muzzle side. The middle portion 7 disposed therebetween extends radially to provide a larger diameter than both end portions. The cylindrical spindle-shaped portion 8 is partially provided with a threaded portion 8*a*. The discharge of a paint is effected through an axial center bore 10 in the body 1. The sleeve 9 is provided with an annularly constricted portion 9*b*. The sleeve 9 is further provided with a tapped portion 9*a* to engage the threaded portion 8*a* of the body 1 so that the sleeve 9 may be fixedly mounted upon the body 1. The piliform members 4 are held in a cylindrical space 2 left between the spindle-shaped portion 8 of the body 1 and the sleeve 9.

The piliform members 4 consist of a comparatively soft material such as horsehair, hog hair or soft synthetic fibers. A plurality of piliform members 4 are bundled in a barrel-shaped manner on the outer surface of the spindle-shaped portion 8, against which the constricted portion 9*b* of the sleeve 9 presses the root portion 4*a* of the piliform members 4 so as to fixedly hold them in the cylindrical space 2 to dispose the remaining portion of the piliform members 4 in a position projecting outwardly of the opening of the sleeve 9 by about 20 to 35 millimeters.

In order to mount the paint-coating brush B on a paint-coating installation, the threaded portion 6 is threaded into a tapped hole 16 in the brush holder 15 of the paint-coating installation.

As might be apparent from FIG. 3, the above-described conventional paint-coating brush B has the disadvantage that the portion of the piliform members 4 projecting outwardly from the cylindrical space 2 is considerably long and consequently liable to be deformed.

In other words, the width of a paint coat undergoes changes, which are caused by the variation of pressure exerted by the piliform members 4 on the surface of an object to be coated with the paint. When this pressure fluctuates, especially when it abruptly increases, it causes the abrupt discharge and trickling of the paint with which the piliform members 4 have been soaked. Another disadvantage is derived from the fact that, because the projecting portion of the piliform members 4 is long, the paint comes in contact with air over a wide surface area. Consequently the paint is dried and hardened in the portions of the piliform members 4 which do not directly take part in the paint coating, i.e., in the middle portion of the piliform members 4 and in the portion close to the cylindrical space 2. Consequently, after the suspension of paint-coating operation, much time must be spent in washing the paint-coating brush B.

The above-described problems may be dissolved to some extent if short piliform members 4 are used so that the portion of the piliform members 4 projecting outwardly from the cylindrical space 2 may be shortened. However, the reduced overall length of the paint-coating brush B gives rise to another problem in that the movement of the brush holder 15 is occasionally hindered by the object to by coated with the paint. This is especially the case when a paint is to be applied to a stepped or narrow portion such as the window frame of an automobile. The paint-coating operation is rendered difficult or even impossible when the brush holder 15 or a pipeline connected thereto comes in contact with an edge or surface of such a stepped or narrow portion.

If bristles made of rigid resin such as nylon are used as the piliform members 4, they are free from liability to deformation, and the width of a paint coat is free from variation even if the pressure exerted by the piliform members 4 on the surface of an object to be coated with the paint undergoes variation. However, the fact that the bristles used as the piliform members 4 make point contact with the surface of the object gives rise to another problem in that uniform paint coating is made impossible, because a paint film with an uneven surface is formed. Still another problem is that the bristly piliform members 4 splash the paint at the time of paint coating, and the surroundings are stained with splashes.

SUMMARY OF THE INVENTION

It is an object of the present invention to provide a paint-coating brush which, is so far as possible, can prevent a paint from trickling, free the width of a paint coat from undergoing a variation even if the pressure exerted by the brush on the surface of an object to be coated with the paint undergoes a variation, and thereby smoothen the automatic painting to be carried out by a paint-coating installation.

An important feature of the present invention is that piliform members are sheathed with a cylindrical cover tube in such a manner that one end portion of the piliform members is left unsheathed, the unsheathed end portion being short enough to restrict the deformation of the piliform members. Consequently the width of a paint coat hardly undergoes changes even if the pressure exerted by the brush on the surface of an object to be coated with the paint undergoes a variation to some extent.

Other objects and features of the present invention will be apparent from the following description presented with reference to the accompanying drawings.

DESCRIPTION OF A PREFERRED EMBODIMENT

Figure 1:
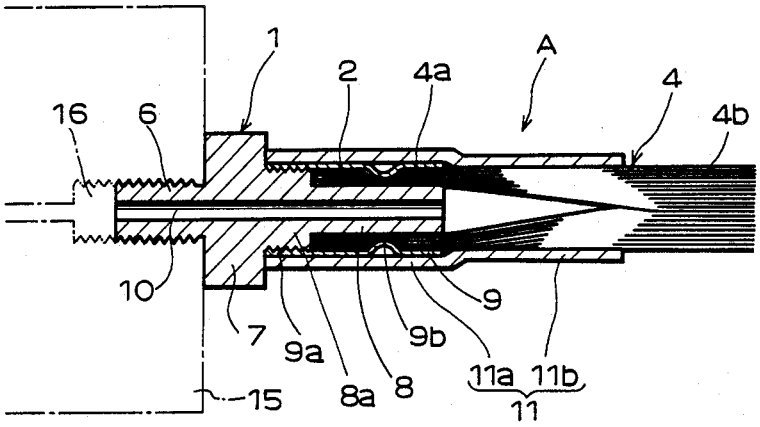
FIG. 1 is a vertical section illustrating an embodiment of the paint-coating brush according to the present invention.
Figure 3:
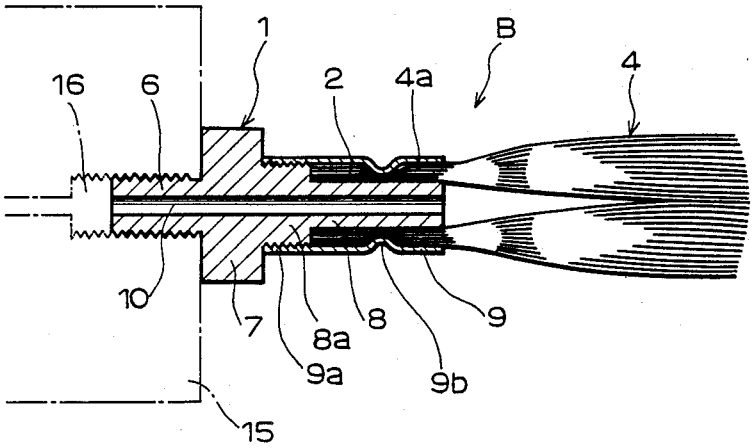
FIG. 3 is a vertical section of a conventional paint-coating brush.

In the drawings, like numerals are employed to designate like parts throughout the views.

A paint-coating brush A shown in FIG. 1 comprises a body 1 made of a metal or synthetic resin, a plurality of soft piliform members 4, a cylindrical sleeve 9 for fastening the piliform members 4 to the body 1, and a cover tube 11 fitting on the sleeve 9 and binding the piliform members 4 in such a manner that one end portion of the piliform members 4 is left unsheathed.

A cylindrical space 2 is left between the spindle-shaped portion 8 of the body 1 and the sleeve 9. The portion of the piliform members 4 projecting outwardly from the cylindrical space 2 has a length of about 20 to 35 millimeters. One end portion **4*b* of the piliform members 4 projecting outwardly from the cylindrical space 2 is left unsheathed with the cover tube 11. The unsheathed end portion 4*b* has a length of about 5 to 15** millimeters.

The cover tube 11, made of a synthetic resin or a metallic material, is in the form of a unitary structure which includes a socket portion **11*a* and a muzzle-side end portion 11*b* different from each other in inside diameter. The socket portion 11*a* is somewhat in a state of force fit on the outer surface of the sleeve 9. The inside diameter of the end portion 11*b* is nearly equal to that of the sleeve 9. The piliform members 4 are bound in a clamped state by the end portion 11*b* in such a manner that only the end portion 4*b* is free to be deformed to some extent. The cover tube 11 is demountable so that it may be taken off from the sleeve 9 for allowing the piliform members 4** to be easily washed after the use of the paint-coating brush A.

Figure 2:
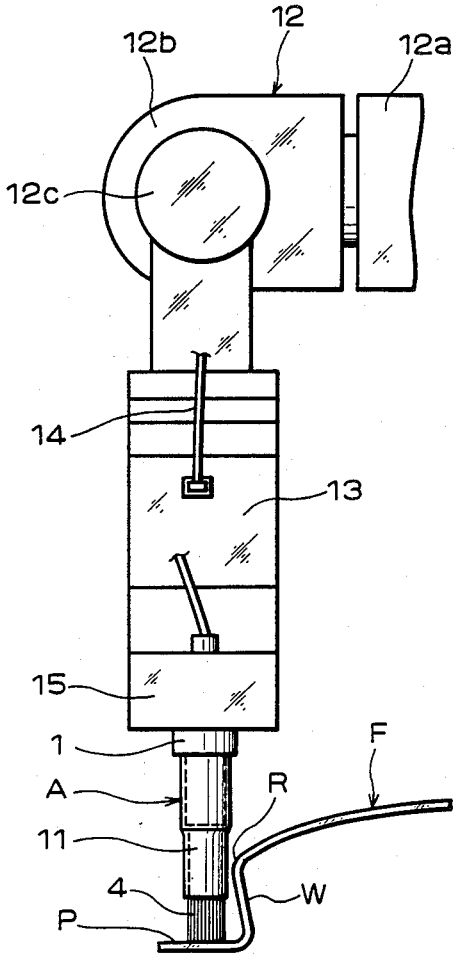
FIG. 2 is a drawing to help explain the actual use of the paint-coating brush shown in FIG. 1, wherein the brush is mounted on a paint-coating installation.

FIG. 2 illustrates how, e.g., a primer is applied to the flange P of an automobile rear window frame F before it is glazed. The application of the primer is carrier out by means of the paint-coating brush A mounted on a paint-coating installation comprising a multiarticular robot 12.

The robot 12 is provided with an arm **12*a*, on the end of which a rotary joint 12*b* and a hinged joint 12*c* are provided. A bracket 13 is provided on the lower end of the hinged joint 12*c*, and a brush holder 15 is provided on the lower end of the bracket 13. In order to mount the paint-coating brush A on the brush holder 15, the threaded portion 6 is threaded into a tapped hole 16 in the brush holder 15. A paint is supplied from a pressure feed apparatus, which is not shown but is well known in the art. The paint passes through a tube 14 and the tapped hole 16, flows into the axial center bore 10 in the body 1, and is ejected from the end of the spindle-shaped portion 8. Now the end portion 4*b* of the piliform members 4** is soaked with the paint to be applied to the flange P.

The above-described paint-coating brush A has an advantage that the deformation of the end portion **4*b* is restricted, because the remaining portion of the piliform members 4 is bound by the cover tube 11. The deformation of the piliform members 4 is not very great, and the width of a paint coat hardly undergoes changes, even if the thrusting power exerted by the robot 12 on the paint-coating brush A undergoes a variation to some extent. Such an advantage serves to prevent a paint from trickling, which would be caused by an abrupt variation of the above-mentioned thrusting power. The paint, with which the piliform members 4 have been soaked, is prevented from being dried and hardened, because the piliform members 4 are sheathed with the cover tube 11 except that the end portion 4*b* is left unsheathed. The paint-coating brush A has such a large overall length that the movement of the brush holder 15 is not hindered by the web W or the crease R of the flange P of an automobile rear window frame F. The piliform members 4 may be soft enough to facilitate the smooth and uniform paint coating and obviate the possibility of allowing the piliform members 4** to splash the paint.

Although the cylindrical cover tube 11 used in the above-described embodiment is rigid, it is not to be deemed limitative of the same. For example, a strap made of a thin metal plate, metal foil or synthetic resin may be wound round the piliform members 4 and the sleeve 9 in such a manner that only the end portion **4*b* is left unsheathed. One has only to unwind this strap in order to take off the cover tube 11 of this type and wash the piliform members 4**.

In place of the threaded portion 6, the body 1 may be provided with a tapped hole to engage a threaded portion provided on the brush holder 15.

What is claimed is:

1. A paint-coating brush comprising:

a body having an axial center bore;

piliform members provided on the outer surface of a cylindrical spindle-shaped portion which is formed at one end of said body;

a cylindrical sleeve which covers said piliform members on said spindle-shaped portion and securely fastens said piliform members to said body, forming a single unit with said body; and a cover tube, said cover tube comprising a cylindrical socket portion having substantially the same inner diameter as the outer diameter of said cylindrical sleeve and an end portion having substantially the same inner diameter as the inner diameter of said cylindrical sleeve, said socket portion and end portion being continuous to form a unitary structure, and said cover tube further being removably fitted on said cylindrical sleeve at its socket portion and covering said piliform members, except for the tip ends thereof, at its end portion.

2. A paint-coating brush to be mounted for automatic application of paint by means of a robot comprising:

a body having an axial center bore;

piliform members provided on the outer surface of a cylindrical spindle-shaped portion which is formed at one end of said body;

a cylindrical sleeve which covers said piliform members on said spindle-shaped portion and securely fastens said piliform members to said body, forming a single unit with said body; and a cover tube, said cover tube comprising a cylindrical socket portion having substantially the same inner diameter as the outer diameter of said cylindrical sleeve and an end portion having substantially the same inner diameter as the inner diameter of said cylindrical sleeve, said socket portion and end portion being continuous to form a unitary structure, and said cover tube further being removably fitted on said cylindrical sleeve at its socket portion and covering said piliform members, except for the tip ends thereof, at its end portion.

* * * * *